US006283338B1

(12) United States Patent
Geier

(10) Patent No.: US 6,283,338 B1
(45) Date of Patent: Sep. 4, 2001

(54) VALVE FOR DISCHARGE FLUIDS KEPT UNDER PRESSURE IN A CONTAINER

(75) Inventor: Adalberto Geier, Villazzano (IT)

(73) Assignee: Coster Tecnologie Speciali S.p.A. (IT)

( * ) Notice: Subject to any disclaimer, the term of this patent is extended or adjusted under 35 U.S.C. 154(b) by 0 days.

(21) Appl. No.: 09/470,348

(22) Filed: Dec. 22, 1999

(30) Foreign Application Priority Data

Dec. 17, 1999 (DE) ..... 198 59 969

(51) Int. Cl.[7] ..... B65D 83/00
(52) U.S. Cl. ..... 222/402.13; 222/153.1
(58) Field of Search ..... 222/402.13, 402.15, 222/153.1

(56) References Cited

U.S. PATENT DOCUMENTS 3,224,645 * 12/1965 Frost ..... 222/402.13
5,310,096 * 5/1994 Rogers et al. ..... 222/402.13

* cited by examiner

*Primary Examiner*—Philippe Derakshani
(74) *Attorney, Agent, or Firm*—Andrus, Sceales, Starke & Sawall

(57) ABSTRACT

A valve (14) is connected to a fluid filled and pressurized container for discharging the fluid (15). A valve body (16) is fixed within a container lid (13). An ascending pipe (21) projects into the container and is connected to a discharge tube (18) which projects into the container lid. An atomizer cap (23) is engaged by a catch mechanism to the circumferential edge (28) of the container lid (13). The cap includes an atomizer nozzle (22) coupled to the discharge tube (18) and oriented approximately perpendicular to the long axis of the container. At the circumferential edge (28) of the container lid (13) there is formed at least one projection (32), which cooperates with a complementary recess on the inner circumferential surface of the atomizer cap (23) in order to achieve a rotationally stable fixation of the latter to the container lid (13), with the nozzle 22 located in accordance with the location of the end of pipe (21) within the container.

11 Claims, 3 Drawing Sheets

FIG. 3
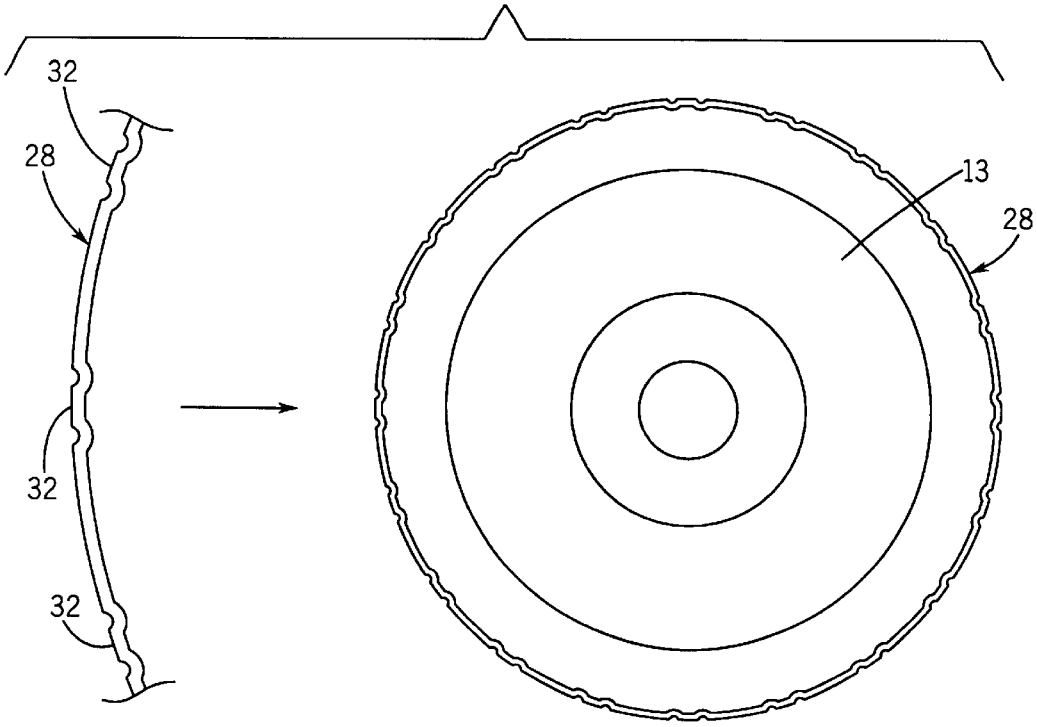
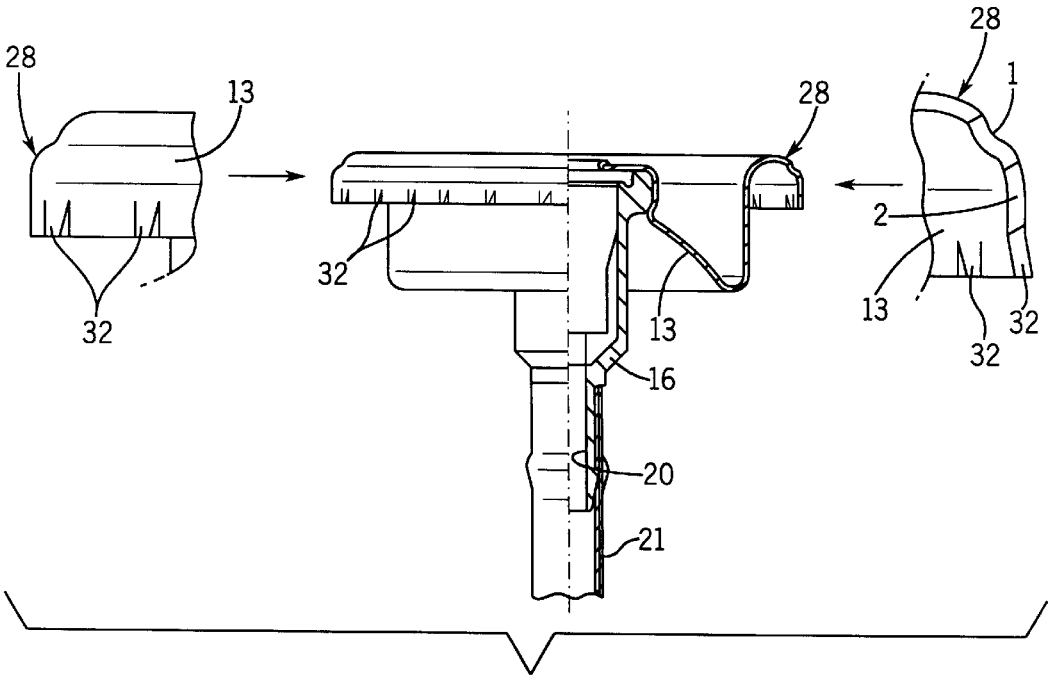
FIG. 4

VALVE FOR DISCHARGE FLUIDS KEPT UNDER PRESSURE IN A CONTAINER

BACKGROUND OF THE INVENTION

The invention relates to a valve for the discharge of fluids that are under pressure in a container, in particular liquids, pastes, gels, cremes or the like, with a valve body that is fixed in a container lid and by way of which an ascending pipe disposed in the interior of the container can be put into fluid communication with a discharge tube that can be actuated from outside the container, and with an atomizer cap that can be locked to the circumferential edge of the container lid and that comprises an atomizer nozzle corresponding to the discharge tube and oriented approximately perpendicular to the container axis.

Such valves and containers provided with such valves are generally known. For aerosol applications it is very often necessary to dispose the atomizer nozzle in a particular spatial relationship to the ascending pipe in the interior of the container; that is, the spray direction must correspond to the site at which the open end of the ascending pipe, at the bottom of the container, sucks in the medium to be sprayed. This applies in particular to the spraying of ironing starch, furniture polish or the like, during which the user ordinarily tilts the container slightly downward. If the open, bottom end of the ascending pipe is not below the spray nozzle, when only about half of the medium has been discharged the bottom end of the ascending pipe is already above the level of the medium to be sprayed, with the result that from then on, substantially only the propellant is sprayed out through the ascending pipe. The remaining propellant then no longer suffices to empty the container completely. Most manufacturers of containers of the kind concerned here therefore, when assembling the device, orient the valve and the associated atomizer cap in such a way that the spray nozzle is above the open, bottom end of the ascending pipe. However, it has been found that during use the atomizer cap very often is rotated on the circumferential edge of the container lid, with the consequence that the original orientation of the atomizer nozzle in relation to the open, bottom end of the ascending pipe is lost. Then the disadvantage described above again arises.

SUMMARY OF THE INVENTION

The object of the present invention is to create a valve with associated atomizer cap in which the originally fixed spatial relations between atomizer nozzle and bottom end of the ascending pipe are preserved, in such a way that the bottom end of the ascending pipe is always below the spray nozzle—i.e., points in the same direction as the spray nozzle.

This object is achieved in accordance with the invention by the characterizing features of claim 1, while preferred structural details are described in the subordinate claims.

The central concept in the present invention is thus that the atomizer cap is force- and form-fitted to the circumferential edge of the container lid, and in particular is held so that it is unable to rotate. This measure ensures that the user of a container provided with a valve constructed in accordance with the invention cannot alter the originally fixed spatial relationship between atomizer nozzle and bottom end of the ascending pipe without destroying the atomizer cap.

Preferably the at least one projection formed at the periphery of the container lid is sharp-edged, so that when the atomizer cap, which as a rule is made of plastic, is set onto the container, said projection becomes embedded in the cap material by forming a complementary depression. The cross-sectional shape of the projection can be rectangular or preferably like a peaked roof.

The at least one projection at the circumferential edge of the container can advantageously be obtained by deforming the edge outward or by stamping out the material to form a vane which is then bent outward.

In principle it is also conceivable that at the inner circumference of the atomizer cap a projection extending radially inward is formed, which corresponds to a complementary recess at the circumferential edge of the container lid, for the purpose of making a rotationally stable connection between these two components.

A preferred embodiment is characterized by the presence of at least three or more projections or recesses, uniformly distributed over the circumferential edge of the container lid.

Ordinarily the container lid is made of sheet metal, in particular tinplate, and the atomizer cap is made of plastic. Between the circumferential edge of the container lid and the associated opening edge of the container, an elastomer seal is also disposed in the conventional manner. The circumferential edge of the container lid, the cross section of which is approximately C- or U-shaped, in the assembled state is crimped around the opening edge of the container, with the interposition of the above-mentioned elastomer sealing ring.

To improve the interlocking between atomizer cap and circumferential edge of the container lid, the latter is bent outward so as to have an approximately U- or C-shaped cross section and in its upper region has on its outer surface a circumferential groove, which in the assembled state cooperates with a complementary projection that extends at least partially beyond the inner circumference of the atomizer cap, such that the bottom edge region of the atomizer cap projects under the lower limit of the circumferential edge of the container lid. As a result, the atomizer cap is firmly held between the above-mentioned groove and the lower limit of the circumferential edge of the container lid. Superimposed on this axial fixation is the fixation against rotation mentioned above. Hence the atomizer cap is permanently immobilized, avoiding all the disadvantages cited above.

BRIEF DESCRIPTION OF THE DRAWINGS

In the following a preferred embodiment of the valve in accordance with the invention is described in detail in relation to a cylindrical container. The drawings are as follows:

FIG. 3 shows a container lid constructed in accordance with the invention as seen from below, such that part of the outer circumference of this container lid is enlarged;

FIG. 4 shows the container lid plus associated valve body constructed in accordance with the invention partially in longitudinal section and partially in side view, together with enlarged drawings of details of the circumferential edge of the container lid in surface and sectional views;

DESCRIPTION OF THE ILLUSTRATED EMBODIMENT

Figure 5:
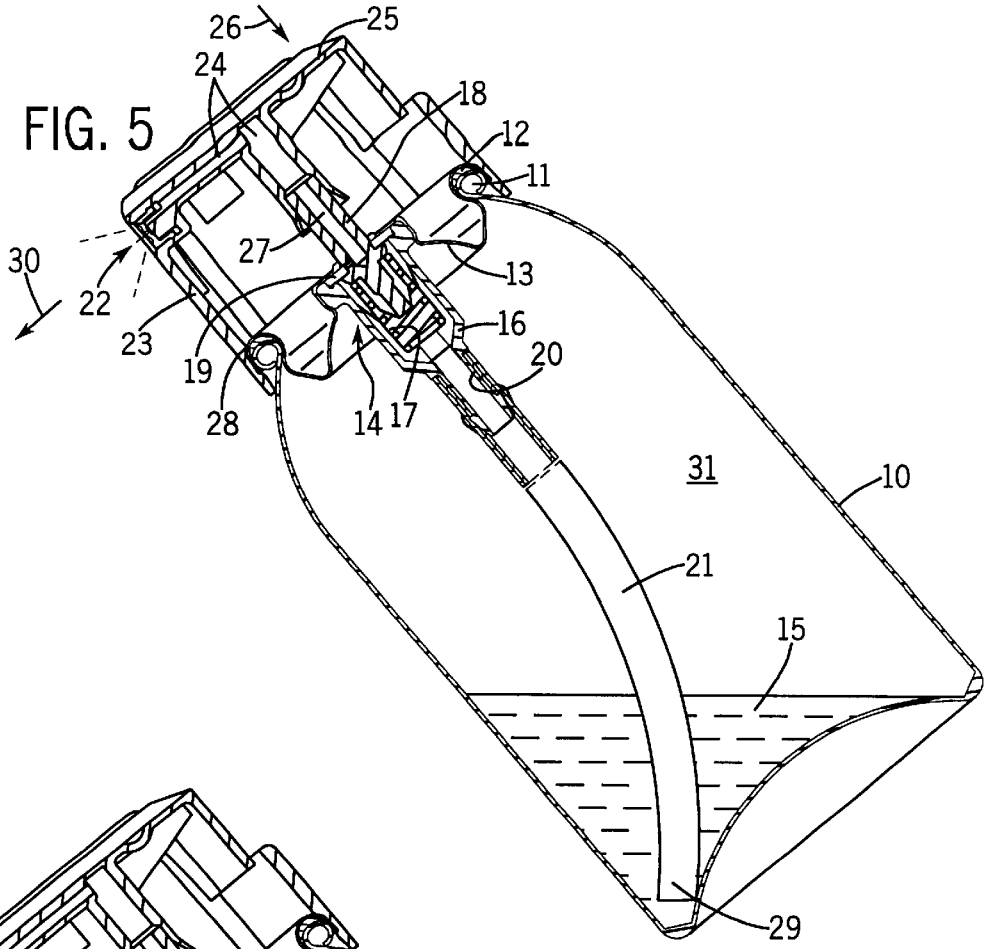
FIG. 5 shows a container provided with a valve in accordance with the invention, in a tilted position.
Figure 6:
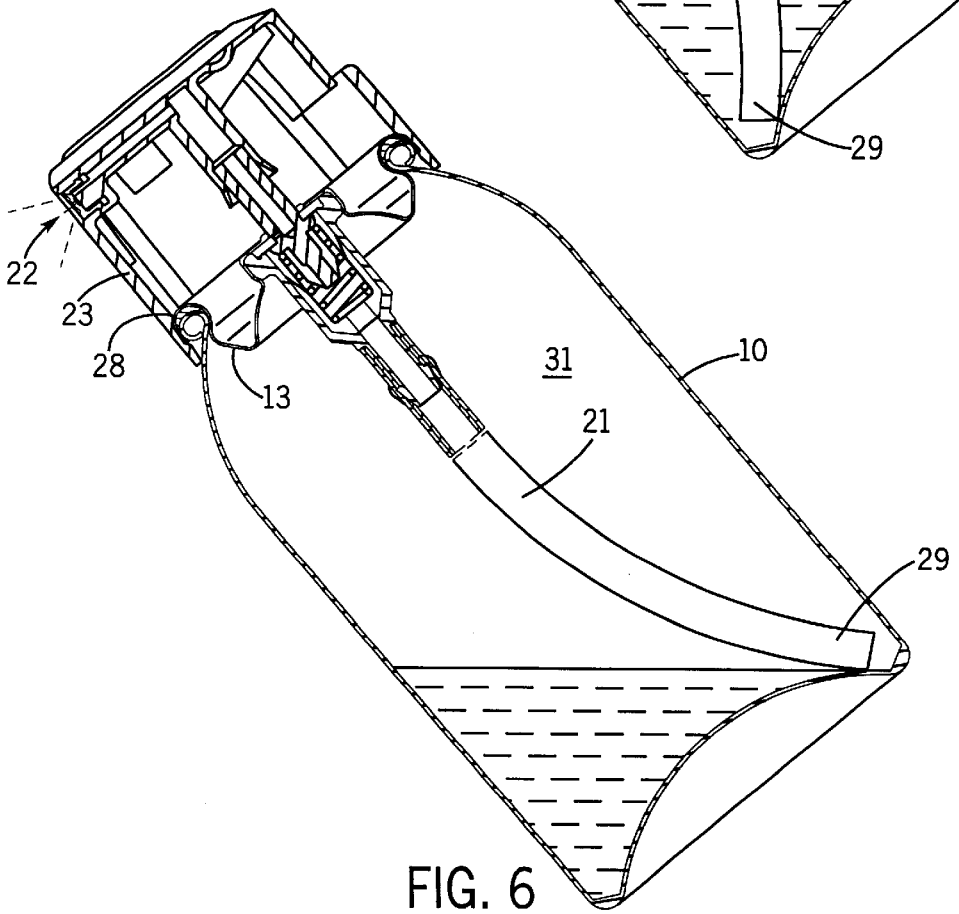
FIG. 6 shows a container provided with a conventional valve in a tilted position, in which the desired spatial relationship between the atomizer nozzle and the open, bottom end of the ascending pipe has been lost owing to rotation of the atomizer cap.

With reference to FIGS. 5 and 6, the problems underlying the present invention will first be presented. FIG. 5, like FIG. 6, shows a container 10 in the shape of a cylinder, onto the opening edge 11 of which a container lid 13 is set, with the interposition of a sealing ring 12. This container lid 13 comprises a valve 14 for discharging fluids contained under pressure in the container 10, in this case the liquid 15. The valve 14 comprises a valve body 16 that can be fixed in a fluid-tight manner to the edge of a lid opening formed in the container lid 13, a discharge tube 18 that is axially displaceable within the valve body and can be moved out of a closed position corresponding to FIG. 5 against the action of an elastic element, here a helical compression spring 17, and a sealing ring 19 made of rubber or a similar elastic sealing material, which is disposed so that it closely surrounds the discharge tube 18 between the edge of the lid opening and the valve body 16. The interior of the valve body 16 is connected to the interior of the container by way of a fluid channel 20, to the opening of which that is within the container there is attached a flexible ascending pipe 21, which reaches the bottom of the container 10.

The discharge tube 18 is in fluid communication with an atomizer nozzle 22 by way of a fluid channel 24 disposed within an atomizer cap 23. The atomizer cap 23 comprises an integrated actuator key 25. When this key is pressed in the direction of the arrow 26, towards the container, the discharge tube 18 is displaced into the valve body with simultaneous opening of the fluid channel 27 formed within the discharge valve, so that this channel communicates with the interior of the valve body 16 and hence with the ascending pipe 21 and the pressurized medium 15. The atomizer cap 23 is fixed by a catch mechanism to the circumferential edge 28 of the container lid 13.

In the case shown in FIG. 5, in which the open, bottom end 29 of the ascending pipe 21 is below the atomizer nozzle 22, the container 10 can be completely emptied even when it is tilted downwards in the spray direction as shown by the arrow 30 in FIG. 5.

If the atomizer cap 23 is not fixed to the circumferential edge 28 of the container lid 13 so that it cannot rotate, the atomizer cap 23 may become turned around the long axis of the container and the valve body, and hence moves relative to the ascending pipe 21. Then it is conceivable that, in the worst case, the atomizer cap 23 will rotate into a position such that the atomizer nozzle 22 is diametrically (with respect to the long axis of the container) opposed to the open, bottom end 29 of the ascending pipe 21, as is shown in FIG. 6. Then after the container 10 has been partially emptied, if it is tilted into the position shown in FIG. 6 there is a risk that the bottom end 29 of the ascending pipe 21 will be above the level of the contained liquid, with the result that propellant 31 is expelled through the ascending pipe 21. Because of the resulting pressure drop in the container 10, it is no longer possible to empty the container completely even when it is upright. This is the problem to be eliminated, by taking measures such that the user is prevented from positioning the atomizer nozzle relative to the bottom end 29 of the ascending pipe 21 in such a way as is shown in FIG. 6.

For this purpose, in the embodiment according to FIGS. 1 to 4 a plurality of projections 32 are provided, in an approximately uniformly spaced distribution, around the circumferential edge 28 of the container lid 13. When the atomizer cap 23 is put into place in the position described with reference to FIG. 5 and shown in FIG. 1 these projections, because of their sharp-edged construction, impress themselves into the inner surface of the cap rim so that they act like "claws" clinging to the atomizer cap. Hence the atomizer cap not only interlocks with the circumferential edge 28 of the container lid 13 to provide axial fixation, but is also fixed to the latter in such a manner as to prevent rotation.

The "claw" action of the projections at the circumferential edge 28 of the container lid 13, as described above, is of course practicable only when the atomizer cap is made of plastic, in the conventional manner. In other cases it would be appropriate to provide the inner surface of the circumferential edge of the atomizer cap with recesses complementary in shape to the projections 32.

As mentioned previously, the projections at the circumferential edge of the container lid are preferably made sharp-edged, so that when the atomizer cap 23 is set onto them they can actually impress themselves into the material thereof or cut into it, so as to achieve the above-mentioned "claw" grip with which the lid edge immobilizes the atomizer cap by way of the latter's inner circumference.

In the extreme case, a fluted outer surface of the circumferential edge 28 of the container lid 13 can be constructed by providing ribs oriented parallel to the long axis of the container and having a triangular cross section.

In the embodiment shown in FIG. 4 the projections 32 are produced by stamping the material to form a vane which is then bent outward.

In the embodiment according to FIG. 3 the projections 32 at the circumferential edge 28 of the container lid 13 are obtained by deforming the edge outwards. In any case care must be taken to ensure that the projections are sharp-edged; that is, they should have sharp boundaries in particular at the edges oriented parallel to the long axis of the container.

In principle a single projection 32 suffices. For increased security aginst twisting of the atomizer cap 23, however, it is advantageous to provide at least three or more projections 32, uniformly distributed over the circumferential edge of the container lid.

It is also in principle conceivable to form radially inward projecting structures on the inner surface of the circumferential edge of the atomizer cap, which cooperate with complementary depressions on the circumferential edge 28 of the container lid 13. The crucial aspect is that a form- and force-fitting connection is created between the atomizer cap 23 and the circumferential edge 28 of the container lid 13, which holds the atomizer cap 23 securely in both the axial and the circumferential direction.

The container lid 13 ordinarily is made of sheet metal, in particular tinplate, whereas—as mentioned above—the atomizer cap 23 is made of plastic.

Figure 2:
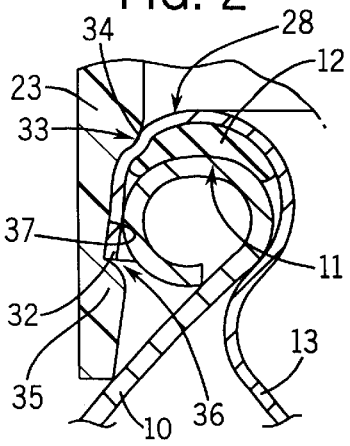
FIG. 2 shows part of the container according to FIG. 1 in longitudinal section, enlarged.

As can readily be seen, especially in FIG. 2, the circumferential edge 28 of the atomizer lid 13 is bent outward, forming an approximately U- or C-shaped cross section, and in the upper region has a circumferential groove 33 which, when the atomizer cap is in place, cooperates with a complementary projection 34 that extends inward from the inner surface of the cap edge, while the bottom edge region 35 of the atomizer cap 23 extends inward beyond the lower boundary 36 of the circumferential edge 28 of the container lid 13. By this means the atomizer cap 23 is locked in the axial direction to the circumferential edge 28 of the container lid 13, being held between the upper circumferential groove 34 and the lower boundary 36. This region of the circumferential edge 28 of the container lid 13 is seated within a depression 37 that extends over the entire circumference of the lid, the upper limit of which is defined by the projection 34 that extends over the circumference, while the lower limit of the depression 37 is defined by the bottom edge region 35 of the atomizer cap 23. The interplay just described between the outer surface of the circumferential edge 28 of the container lid 13 and the atomizer cap 23 ensures the initially mentioned catch engagement, in the axial direction, of the atomizer cap 23 with the circumferential edge 28 of the container lid 13. FIG. 2 also shows very clearly how the projections 32 cooperate with the atomizer cap 23.

Figure 1:
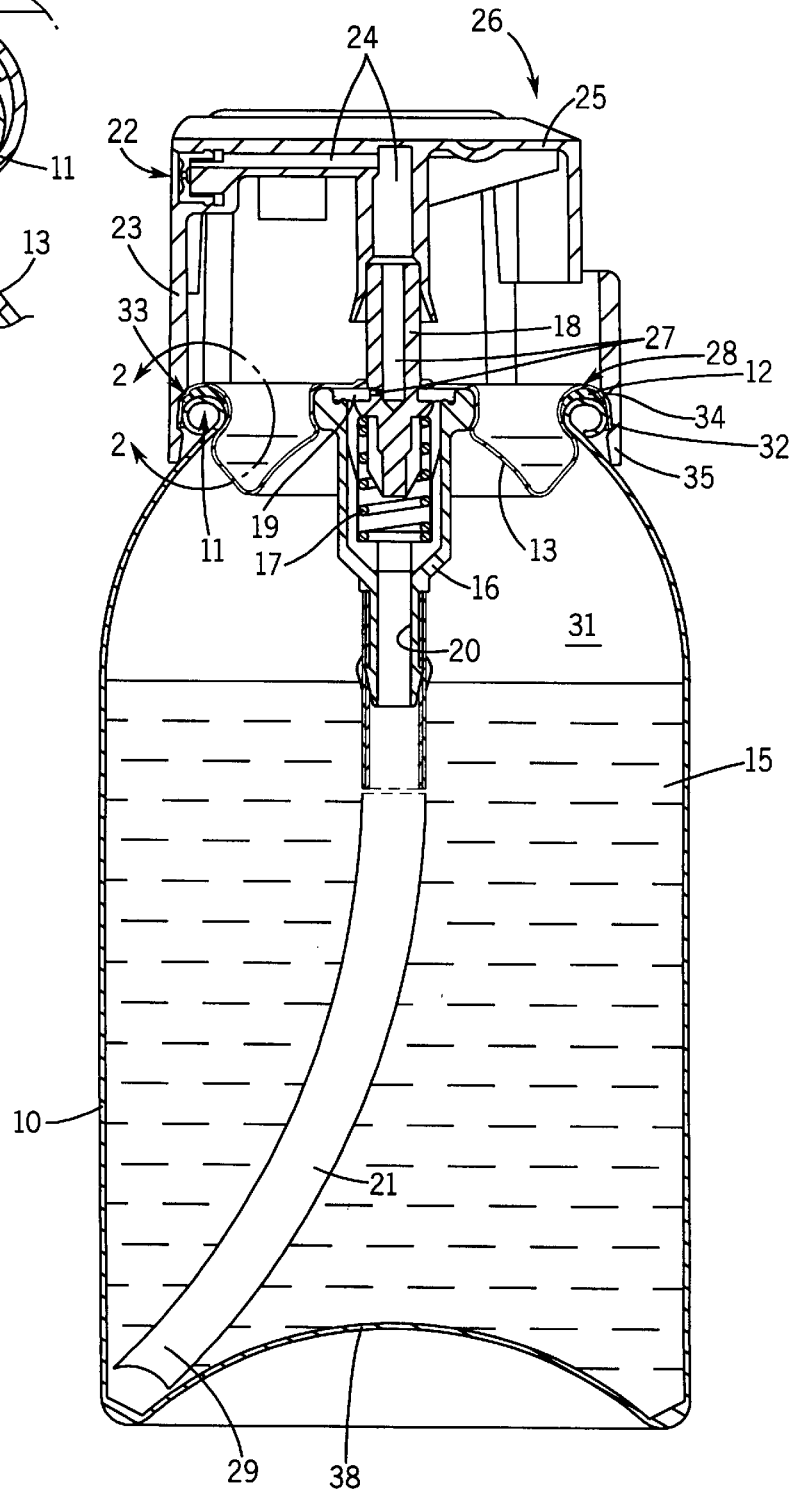
FIG. 1 shows an aerosol container equipped with a valve in accordance with the invention in longitudinal section.

It should also be pointed out that the length of the ascending pipe 21 is made such that its open, bottom end 29 terminates in a corner of the container, i.e. in a corner between the container floor 38 and the side wall of the container 10. The atomizer cap 23 with atomizer nozzle 22 is then placed onto the circumferential edge 28 of the container lid 13 in such a way that the atomizer nozzle 22 is above the bottom end 29 of the ascending pipe 21, in the same longitudinal plane extending through the long axis of the container, as shown in FIG. 1.

FIG. 2 also shows very clearly the sealing ring 12 between the opening edge 11 of the container 10 and the circumferential edge 28 of the container lid 12. The circumferential edge 28 of the container lid 13 is crimped around the opening edge 11 of the container 10, and interposed between them is the sealing ring 12 made of rubber or similar elastic sealing material.

The described and claimed rotational fixation of the atomizer cap 23 is also claimed as an inventive improvement independent of the described arrangement and positioning of the ascending pipe 21, because the crucial aspect for the invention is the described and claimed interplay between the circumferential edge 28 of the container lid 13 on one hand and the atomizer cap 23 on the other hand.

All the characteristics disclosed in the application documents are claimed as essential to the invention insofar as they are new to the state of the art, singly or in combination.

LIST OF REFERENCE NUMERALS

10 Container
11 Edge of container opening
12 Sealing ring
13 Container lid
14 Discharge valve
15 Liquid
16 Valve body
17 Helical compression spring
18 Discharge tube
19 Sealing ring
20 Fluid channel
21 Ascending pipe
22 Atomizer nozzle
23 Atomizer cap
24 Fluid channel
25 Actuator key
26 Arrow
27 Fluid channel
28 Circumferential edge
29 Open, bottom end of ascending pipe 21
30 Arrow
31 Propellant
32 Projection
33 Groove
34 Projection
35 Bottom edge region of atomizer cap 23
36 Lower limit of the outer circumferential edge 28 of the container lid 13
37 Recess
38 Bottom of container

What is claimed is:

1. A valve assembly (14) for discharging fluids (15) from a container (10) having a long axis and under pressure, said valve assembly including a valve body (16) fixed to a container lid (13), said lid having a circumferential edge (28) and a discharge tube connected to said valve body (16) and further connected to an ascending pipe (21) configured to extend into the container for fluid communication and discharge from the container, and an atomizer cap (23) having an integral body and having an atomizer nozzle (22) secured within said cap (23) and configured for connection to the discharge tube (18) and oriented approximately perpendicular to the long axis of the container, a discharge opening in said cap (23) aligned with said nozzle (22) for discharging of fluid from said container, said cap (23) having an inner integral circumferential surface, configured to fit over said lid, the improvement in a catch mechanism connecting said cap (23) to said circumferential edge (28) of the container lid (13), comprising at least one offset portion on said circumferential edge (28) of the container lid (13), a complementary offset portion on said inner circumferential surface of said atomizer cap (23), said cap being attached to said circumferential edge of said container lid with said offset portion of said cap engaging said offset portion of the circumferential edge of said lid and thereby connecting the cap to the container lid and establishing a rotationally stable fixation of said cap (23) to the container lid (13) to hold said atomizer nozzle (22) in predetermined orientation with respect to said container (10).

2. The valve assembly according to claim 1 wherein said offset portion of said circumferential edge of said container lid includes an outward projection (32) and said offset projection portion on said atomizer cap includes a complementary recess.

3. The valve assembly of claim 1 wherein said offset portion of said circumferential edge of said lid is a recess projecting inwardly; and said offset portion on said atomizer cap (23) is an outward projection complementing said recess.

4. The valve assembly of claim 2 wherein said offset portion of said projection (32) on said lid includes an outer sharp edge whereby said edge is set into said recess in said cap and thereby producing the complementary recess.

5. The valve assembly of claim 1 wherein at least three complementary offset portions are uniformly distributed over the circumferential edge and said atomizer cap.

6. The valve assembly of claim 1 wherein the container lid including said circumferential edge made of sheet metal and said atomizer cap (23) is made of plastic.

7. The valve assembly of claim 1 wherein said sheet metal is tin plate.

8. The valve assembly of claim 1 wherein said ascending pipe (21) projecting into said container is located in one generally radial direction, and said atomizer cap (23) engages the circumferential edge (28) to direct the atomizer nozzle (22) in the same direction as the bottom end of the ascending pipe.

9. The valve assembly of claim 1 wherein said circumferential edge (28) of said lid is bent outwardly and backwardly to form an approximately U-shaped cross-section with the container at the upper end of the container and with said bent portion being located on the exterior side of the container, and wherein said edge (28) includes a circumferential groove (23) which engages a complementary projection (34) of the inner surface of the atomizer cap (23) for said groove end projection extending over at least a part of the circumference of said container, the bottom edge of said container cap projecting downwardly beyond the lower edge (38) of the circumferential edge (28) whereby said projection (34) and the bottom edge (35) of said cap to positively establish a catch interengagement therebetween.

10. The valve assembly of claim 2 wherein said outward portion including a sharp edge includes a vane formed in the container lid (13), said vane being bent outwardly of said circumferential edge for engagement with the complementary recess of said atomizer cap.

11. The valve assembly of claim 5 wherein said cap secured to said lid locates the atomizer nozzle (22) positioned substantially aligned with the bottom end of the ascending pipe (21) within said container.

* * * * *

UNITED STATES PATENT AND TRADEMARK OFFICE

CERTIFICATE OF CORRECTION

PATENT NO. : 6,283,338 B1
DATED : September 4, 2001
INVENTOR(S) : Adalberto Geier It is certified that error appears in the above-identified patent and that said Letters Patent is hereby corrected as shown below:

Title page,
Under Item [30], Foreign Application Priority Data, delete "Dec. 17, 1999" and substitute therefore -- Dec. 23, 1998 --.

Column 6,
Line 24, after "surface" delete ",";
Line 35, after "said" (second occurrence) add -- cap and --;
Line 36, after "in" insert -- a -- and after "predetermined" insert -- fixed --; and,
Line 37, after "(10)" insert -- , said nozzle (22) being operable with said cap (23) in said stable fixation to discharge the fluid from the container 910) and from said cap (23) --.
Line 58, delete "1" and substitute therefor -- 6 --.

Signed and Sealed this

Twenty-fifth Day of June, 2002

*Attest:*

*Attesting Officer*

JAMES E. ROGAN
*Director of the United States Patent and Trademark Office*